US008185970B2

(12) United States Patent
Summers et al.

(10) Patent No.: US 8,185,970 B2
(45) Date of Patent: May 29, 2012

(54) FAUX-SHIRT GIRDLE

(75) Inventors: Irene A. Summers, Saratoga Springs, UT (US); Victoria Ah You, Cedar Hills, UT (US)

(73) Assignee: Maidenform Brands, Inc., Iselin, NJ (US)

( * ) Notice: Subject to any disclaimer, the term of this patent is extended or adjusted under 35 U.S.C. 154(b) by 1389 days.

(21) Appl. No.: 11/478,247

(22) Filed: Jun. 28, 2006

(65) Prior Publication Data

US 2007/0094765 A1 May 3, 2007

Related U.S. Application Data

(60) Provisional application No. 60/694,623, filed on Jun. 28, 2005.

(51) Int. Cl.
*A41D 1/22* (2006.01)
*A41C 3/00* (2006.01)

(52) U.S. Cl. ..... 2/69; 2/105; 2/106; 450/155

(58) Field of Classification Search ..... 2/69, 67, 2/115, 113, 105, 106, 117, 243.1, 73; 450/155, 450/3, 6, 7, 11, 17, 23, 95
See application file for complete search history.

(56) References Cited

U.S. PATENT DOCUMENTS

| | | | |
|---|---|---|---|
| 357,068 | A | 2/1887 | Dalby |
| 570,696 | A | 11/1896 | Brown |
| 933,739 | A | 9/1909 | Bodensiek |
| 1,110,749 | A | 9/1914 | De Blieux |
| 1,121,005 | A | 12/1914 | Farnsworth |
| 1,191,865 | A | 7/1916 | Workman |
| 1,249,446 | A | 12/1917 | Mell |
| 1,683,510 | A | 9/1928 | Wiese |
| 1,774,613 | A | 9/1930 | Pidgeon |
| 1,777,215 | A | 9/1930 | McGill |

(Continued)

FOREIGN PATENT DOCUMENTS

DE G 85 13 103.2 U1 8/1985

(Continued)

OTHER PUBLICATIONS

Suzanne S. Brown; Give Yourself a Squeeze: Outerwear corsets shape up as latest trend in fashion revivals; newspaper; Feb. 8, 2004; p. L-03; Section STL; Denver Post; Denver Colorado. Target Ad, Self Magazine, Jun. 2007, (3 pages), U.S.A.
Get More From Your Cardio Time, Self Magazine, Jan. 2006, (3 pages), U.S.A.
you@self.com, Self Magazine, Dec. 2007, (2 pages), U.S.A.
Do good while you shop, Lucky Magazine, Oct. 2006, (2 pages), U.S.A.
Belly Bra, JC Penney Catalog, 2006, p. 165 (1 page), U.S.A.
Belly Bra, Mar. 3, 1992, (10 pages).
Spanx Hide & Sleek Cami 050, Oct. 30, 2007 (2 pages), available at http://www.herroom.com/SPANX-050-Hide--Sleek-Cami.shtml.
Spanx Hide & Sleek Full Slip060A, Oct. 31, 2007, (3 pages) available at http://www.herroom.com/SPANX-060A-Hide--Sleek-Full-Slip-18-Inch.shtml.
WWD Intimates, 2006 (2 pages).
Too Busy for the Gym?, Glamour.com, Oct. 24, 2007, (1 page), available at http://www.glamour.com/fashion/blogs/slaves-to-fashion/2007/10/too-bus.
Hidden Agenda—Shapewear Report, InStyle Magazine, Sep. 2007, (5 pages).

(Continued)

*Primary Examiner* — Gloria Hale
(74) *Attorney, Agent, or Firm* — Workman Nydegger

(57) ABSTRACT

A faux-shirt girdle for use to shape and support the abdomen of a user while also serving to substantially cover a user's midriff and lower back regions is discloses. The girdle comprises a girdle portion and a shirt portion coupled to the bottom of the girdle portion. The girdle portion is configured to provide support to the user's abdomen region. The shirt portion is configured to cover the user's midriff, and to reduce migration of the lower portion of the girdle portion toward the user's chest line. The shirt portion attached to the bottom of the girdle portion and an elastic or resilient band attached to the top of the girdle portion both work to reduce migration or bunching of the girdle portion around the middle of the torso. The shirt portions can be made of any fabric and can be tucked into, or worn over, a user's other external clothing layer.

29 Claims, 5 Drawing Sheets

U.S. PATENT DOCUMENTS

| | | | | |
|---|---|---|---|---|
| 1,813,043 | A | | 7/1931 | Foreman |
| 1,886,049 | A | | 11/1932 | Rothblum |
| 1,931,822 | A | | 10/1933 | Hoffman |
| D91,329 | S | | 1/1934 | Redman |
| 1,977,329 | A | | 10/1934 | Tobin |
| 2,033,456 | A | | 3/1936 | Cunningham |
| 2,040,058 | A | | 5/1936 | Mendel et al. |
| 2,052,784 | A | | 9/1936 | Martin |
| 2,052,935 | A | | 9/1936 | Moran |
| 2,076,748 | A | | 4/1937 | Schweig |
| 2,097,777 | A | | 11/1937 | Rothman |
| D110,662 | S | | 7/1938 | Rielly |
| 2,190,030 | A | | 2/1940 | Kops |
| D128,536 | S | | 7/1941 | Weil |
| D129,078 | S | | 8/1941 | Monteil |
| D129,894 | S | | 10/1941 | Abeles |
| 2,274,382 | A | | 2/1942 | Richman |
| 2,310,103 | A | | 2/1943 | McDonald |
| 2,335,751 | A | | 11/1943 | Friedman |
| 2,579,547 | A | | 12/1951 | Cadous |
| D170,694 | S | | 10/1953 | Kahn |
| D174,038 | S | | 2/1955 | Goldstein |
| D174,114 | S | | 3/1955 | Dior |
| D174,115 | S | | 3/1955 | Dior |
| D174,194 | S | | 3/1955 | Prochaska |
| D177,982 | S | | 6/1956 | Kahn |
| D181,626 | S | | 12/1957 | Cassini |
| 2,963,022 | A | | 12/1960 | Spetalnik |
| D191,347 | S | | 9/1961 | Herman |
| 3,026,875 | A | | 3/1962 | Kaupp |
| 3,036,574 | A | | 5/1962 | Jeffrey |
| 3,060,446 | A | | 10/1962 | Horne |
| 3,066,675 | A | | 12/1962 | Herman |
| 3,093,138 | A | * | 6/1963 | Herman ..... 450/30 |
| 3,217,713 | A | | 11/1965 | Kunel |
| D211,231 | S | | 6/1968 | Salisky |
| 3,421,513 | A | | 1/1969 | Landau |
| 3,422,818 | A | | 1/1969 | Erteszek |
| 3,454,013 | A | | 7/1969 | Cahill |
| 3,479,844 | A | | 11/1969 | Silvain |
| 3,556,106 | A | | 1/1971 | Rosner |
| 3,582,993 | A | | 6/1971 | Keller |
| 3,699,590 | A | | 10/1972 | Webber et al. |
| D234,649 | S | | 4/1975 | Lo Cascio |
| D239,475 | S | | 4/1976 | Lo Cascio |
| 3,949,426 | A | | 4/1976 | George |
| 4,059,117 | A | | 11/1977 | Rosenfeld |
| 4,154,249 | A | | 5/1979 | Darring |
| 4,377,007 | A | | 3/1983 | Sudjian |
| 4,601,069 | A | * | 7/1986 | Fiore et al. ..... 2/106 |
| 4,916,755 | A | | 4/1990 | Feigenbaum et al. |
| 4,976,653 | A | | 12/1990 | White |
| 5,083,316 | A | | 1/1992 | Kuehner |
| 5,094,648 | A | * | 3/1992 | Turner ..... 450/155 |
| 5,461,725 | A | * | 10/1995 | Witczak ..... 2/104 |
| 5,566,392 | A | | 10/1996 | Dzelzkalns |
| 5,605,060 | A | | 2/1997 | Osborne |
| 5,620,412 | A | | 4/1997 | Modglin |
| D391,740 | S | | 3/1998 | Barrington et al. |
| 5,902,170 | A | | 5/1999 | Ganz |
| 5,915,531 | A | * | 6/1999 | Hilpert et al. ..... 2/69 |
| 6,000,993 | A | | 12/1999 | Erwin |
| 6,061,832 | A | | 5/2000 | Morrison, Jr. |
| 6,062,946 | A | | 5/2000 | Rosenberg |
| 6,076,187 | A | * | 6/2000 | Wallerstein ..... 2/115 |
| 6,146,240 | A | | 11/2000 | Morris |
| 6,185,741 | B1 | | 2/2001 | Kehoe |
| D452,600 | S | | 1/2002 | Kim |
| D453,058 | S | | 1/2002 | Kim |
| D453,255 | S | | 2/2002 | Kim |
| 6,430,748 | B1 | | 8/2002 | Burkhart |
| 6,550,286 | B2 | | 4/2003 | Querquant |
| D476,464 | S | | 7/2003 | Jenkins |
| 6,688,943 | B2 | | 2/2004 | Nagaoka |
| 6,846,217 | B1 | | 1/2005 | Struble et al. |
| 7,074,204 | B2 | | 7/2006 | Fujii |
| 7,083,494 | B2 | * | 8/2006 | Sandroussi et al. ..... 450/31 |
| 7,160,262 | B2 | | 1/2007 | Wicks |
| D556,978 | S | | 12/2007 | Thunstedt |
| 7,395,557 | B1 | | 7/2008 | Ledyard |
| D595,480 | S | | 7/2009 | Giugliano |
| D606,285 | S | | 12/2009 | Schindler |
| D616,627 | S | | 6/2010 | Schindler |
| D622,477 | S | | 8/2010 | Schindler |
| 2006/0242748 | A1 | | 11/2006 | Martz |
| 2007/0094765 | A1 | | 5/2007 | Summers et al. |
| 2008/0078208 | A1 | | 4/2008 | Kronbach |
| 2008/0134409 | A1 | | 6/2008 | Karasina |
| 2008/0229474 | A1 | | 9/2008 | Fons et al. |
| 2008/0244805 | A1 | | 10/2008 | Griffin |

FOREIGN PATENT DOCUMENTS

| | | | |
|---|---|---|---|
| DE | 20 2005 000 716 | U1 | 3/2005 |
| EM | 3855620-0106 | A1 | 1/2005 |
| EM | 454202-0027 | A1 | 2/2006 |
| EM | 454202-0121 | A1 | 2/2006 |
| EM | 633755-0027 | A1 | 1/2007 |
| EM | 730403-0023 | A1 | 10/2007 |
| EP | 0174179 | | 3/1986 |
| EP | 0774241 | | 5/1997 |
| EP | 1082951 | | 3/2001 |
| EP | 1125566 | | 8/2001 |
| GB | 116526 | A | 6/1918 |
| GB | 212307 | A | 3/1924 |
| GB | 1 603 600 | A | 11/1981 |
| GB | D3020687 | | 7/2005 |
| GB | D4004524 | | 10/2007 |
| JP | 2-82707 | U | 6/1990 |
| JP | 2001-172806 | A | 6/2001 |
| JP | 2002-138302 | A | 5/2002 |
| JP | 2003-129303 | A | 5/2003 |
| JP | 2005-281893 | | 10/2005 |
| JP | 2006-316359 | | 11/2006 |
| JP | 2007-146337 | | 6/2007 |
| JP | 2007-303002 | | 11/2007 |
| JP | 2008-156812 | | 7/2008 |
| WO | 9608217 | | 3/1996 |
| WO | 0175201 | | 10/2001 |

OTHER PUBLICATIONS

Sassybax, Underwire Torso Trim, Oct. 2007, (2 pages), available at http://web.archive.org/web/20071020033219/sassybax.com/underwire_trim.php.

Nancy Ganz The Belly Band Convertible Bodybriefer 3313, Her-Room, Nov. 25, 2007, (2 pages), available at http://web.archive.org/web/20100908185713/http://www.herroom.com/Nancy.

Tummy Tee, Redefyne, Oct. 2005, available at http://www.redefyne.com/tummytee.html.

Skinny Cami, sale on Apr. 22, 2006, available at http://www.skinnycami.biz/files/.

U.S. Appl. No. 61/021,212, filed Jan. 15, 2008.

Vogue, Bathing Suit, Apr. 15, 1960, (2 pages), U.S.A.

Self Magazine, Bathing Suits, Jun. 2000, (2 pages), U.S.A.

Self Magazine, "My best stress buster is . . . ", Apr. 2002, p. 200 (2 pages), U.S.A.

Lucky Magazine, Tied to the Cause, Oct. 2003, (2 pages), U.S.A.

Lucky Magazine, Style Spy, Jan. 2002, (2 pages), U.S.A.

JC Penney Catalog, 2002-2003, p. 26 (1 page), U.S.A.

WWD Intimates, Mar. 7, 2005 (2 pages), U.S.A.

1. Flirtations Corset, Subtract line, 1995 (1 page).

* cited by examiner

FAUX-SHIRT GIRDLE

CROSS-REFERENCE TO RELATED APPLICATIONS

This application claims the benefit of U.S. Provisional Patent Application Ser. No. 60/694,623, filed on Jun. 28, 2005, entitled FAUX-SHIRT GIRDLE, and incorporated herein in its entirety by this reference.

BACKGROUND OF THE INVENTION

1. The Field of the Invention

The present invention relates to the field of clothing, more particularly to clothing for aesthetic and medical purposes.

2. The Relevant Technology

The fashion for clothing is an ever changing thing. What is popular one month may be out of style the next. One trend that is prevalent in today's day and age is the idea of having increased bodily exposure. Shorts are getting shorter, and shirts are getting smaller and more revealing. In addition, the cut of pants is getting lower. Most retailers, in order to make sales, stay with the times and fashions. More clothing companies are making their shirts shorter and smaller, and are making their shorts and pants to have a lower cut, meaning the normal wearing position of the upper portion of the article is moving down the hip rather than above the hips. As such, it is difficult to find clothing that covers the thorax and/or midriff regions of the body.

BRIEF SUMMARY OF THE INVENTION

An exemplary embodiment of the invention relates to a girdle comprising a girdle portion, elastic attached to the top of the girdle portion, and a lower faux shirt portion attached to the bottom of the girdle portion. The girdle portion serves to provide shape and support to the abdomen region of the user. The elastic and lower faux shirt portion act together to reduce the tendency for the girdle to migrate toward the upper part of the abdomen or lower part of the torso, which reduces the girdle's effectiveness.

Another advantageous feature of the invention is its utility in giving the illusion that the user of the girdle is wearing a shirt underneath the user's exterior clothing. The lower faux shirt portion is configured to be worn over a portion of the user's clothing, such as the upper portions of a pair of pants or shorts, such that the shirt portion is exposed. Thus, the lower faux shirt portion serves to substantially cover the user's midriff. The present invention has the effect of providing the user with shaping, support, modesty, and a fashionable accent to the user's wardrobe.

The preset invention affords a user an added benefit of having a bottom portion that gives the illusion that a shirt is being worn under the user's other clothing. The lower faux shirt portion can be either tucked into, worn under, or worn over the top of the user's other clothing, and provides functional support to the girdle by inhibiting the tendency of the bottom portion of the girdle to ride up towards the upper part of the abdomen or lower part of the torso. In one embodiment, the girdle gives coverage from just below the chest-line down to the hip and has the ability to give the illusion of a shirt.

In an alternative embodiment, the girdle may be incorporated into various designs of shirts so as to provide the added benefits of support and modesty, while maintaining a certain level of style. For example, in one embodiment, the girdle may include shoulder straps, such as those more commonly know as spaghetti straps, stitched to the upper part of the girdle portion. In an alternative embodiment, the girdle may be incorporated into a tank-top design or a cap sleeve design. In this embodiment, the upper portion of the girdle includes a cloth portion stitched to the upper portion of the girdle portion and has the appearance of a tank-top or a cap sleeve shirt. In yet an alternative embodiment, the girdle is incorporated into a tee shirt or even a buttoned shirt. The girdle may be worn without other clothing if desired, or may be utilized in connection with other shirts or other articles of clothing. The girdle may be worn under a shirt or over a shirt, and may be tucked into pants or worn over pants. The girdle may be worn by both males and females. It may be sized and configured to meet the size constraints and desired support of any particular individual, whether it is a child or an overweight adult.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF EXEMPLARY EMBODIMENTS

An exemplary embodiment of the invention relates to a girdle comprising a girdle portion, a resilient material, such as elastic attached to the top of the girdle portion, and a lower faux shirt portion attached to the bottom of the girdle portion. The girdle portion serves to provide shape and support to the abdomen region of the user. The elastic and lower faux shirt portion act together to reduce the tendency for the girdle to migrate toward the upper part of the abdomen or lower part of the torso, which reduces the girdle's effectiveness.

Another advantageous feature of the invention is its utility in giving the illusion that the user of the girdle is wearing a shirt underneath the user's exterior clothing. The lower faux shirt portion is configured to be worn over a portion of the user's clothing, such as the upper portions of a pair of pants or shorts, such that the shirt portion is exposed. Thus, the lower faux shirt portion serves to substantially cover the user's midriff. The present invention has the effect of providing the user with shaping, support, modesty, and a fashionable accent to the user's wardrobe.

The preset invention affords a user an added benefit of having a bottom portion that gives the illusion that a shirt is being worn under the user's other clothing. The lower faux shirt portion can be either tucked into, worn under, or worn over the top of the user's other clothing, and provides functional support to the girdle by inhibiting the tendency of the bottom portion of the girdle to ride up towards the upper part of the abdomen or lower part of the torso. In one embodiment, the girdle gives coverage from just below the chest-line down to the hip and has the ability to give the illusion of a shirt.

In an alternative embodiment, the girdle may be incorporated into various designs of shirts so as to provide the added benefits of support and modesty, while maintaining a certain level of style. For example, in one embodiment, the girdle may include shoulder straps, such as those more commonly know as spaghetti straps, stitched to the upper part of the girdle portion. In an alternative embodiment, the girdle may be incorporated into a tank-top design or a cap sleeve design. In this embodiment, the upper portion of the girdle includes a cloth portion stitched to the upper portion of the girdle portion and has the appearance of a tank-top or a cap sleeve shirt. In yet an alternative embodiment, the girdle is incorporated into a tee shirt or even a buttoned shirt. The girdle may be worn without other clothing if desired, or may be utilized in connection with other shirts or other articles of clothing. The girdle may be worn under a shirt or over a shirt, and may be tucked into pants or worn over pants. The girdle may be worn by both males and females. It may be sized and configured to meet the size constraints and desired support of any particular individual, whether it is a child or an overweight adult.

Figure 1:
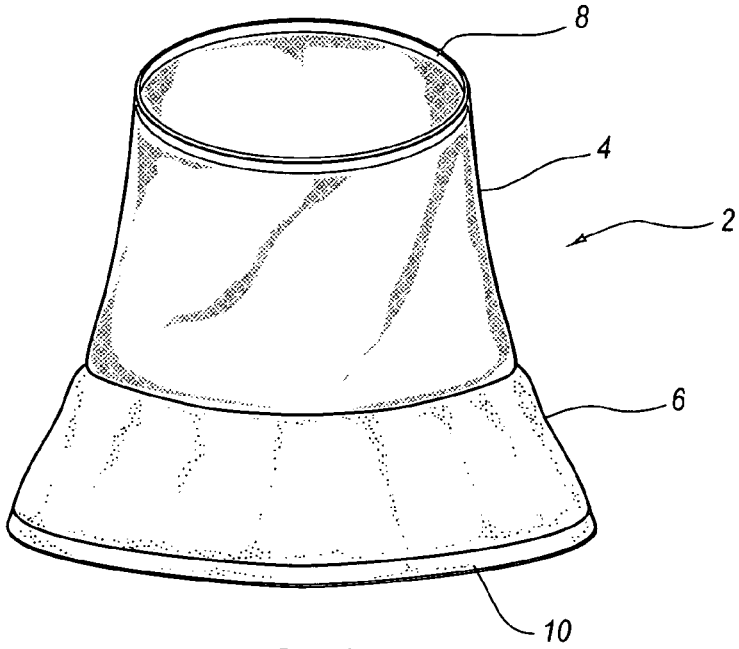
FIG. 1 illustrates an exemplary embodiment of a faux-shirt girdle.

FIG. 1 illustrates a faux-shirt girdle, or girdle 2 having improved versatility and functionality. Girdle 2 is configured to provide support to the abdomen region of a user, while reducing migration of the girdle upon the user's body. Girdle 2 if further configured to at least be partially exposed so as to provide additional body coverage for the user around the user's stomach or midriff and lower back. The girdle of the present invention is particularly advantageous in light of modern fashion trends, which trends are to have lower cut jeans and shorts, as well as shorter shirts. Thus, girdle 2 is configured to provide shape and support to a user while minimizing girdle migrations, as well as provide increased body coverage.

In this embodiment, girdle 2 comprises a girdle portion 4 and a lower faux shirt portion 6 coupled to girdle portion 4, such as by stitching or with a seam. Girdle portion 4 is configured to provide support and shape to a user's body. Girdle portion 4 can be utilized to provide support and shape to the abdomen region of a user. In one embodiment, girdle portion 4 includes a resilient band 8 coupled to the upper portion of girdle portion 4. Band 8 can comprise a separate piece of material stitched to girdle portion 4 or can comprise a bunched up resilient portion of girdle portion 4. Resilient band or elastic member 8 is configured to reduce migration of the upper portion of girdle portion 4. Elastic member 8 has sufficient resilience to mold to the body's abdomen, just below the chest, yet sufficiently maintain the position of the upper portion of girdle portion 4 when sufficiently sized to a user's body.

In one embodiment, girdle portion 4 can be made of a girdle material and can have a uniform, tapered, or silhouette contour that provides support and shapes the abdominal region of a user. The girdle portion 4 can also have a non-uniform pattern of increased support in certain regions of the girdle 2, such as in the back, front, or sides, by using different or reinforced girdle material in specified locations. The girdle portion 4 can be made of either one piece of girdle material or a front and a back section being joined at the two sides of the girdle 2.

Girdle portion 4 may comprise any material typically utilized in connection with elastic girdles, such as nylon, cotton, or a combination of other types of fabrics. The type of material may be chosen from a number of fabrics or fabric combinations in order to achieve a desired elasticity, as one skilled in the art would appreciate. Girdle portion 4 is made of any elastic material that tends to shape, support, or control the user's body. The material utilized in connection with the girdle portion 4 may provide varying levels of support and/or shaping. For example, materials may be chosen having characteristics of greater or lesser elasticity or by using multiple layers (most common being double and triple paneling) of a material with a high level of elasticity. The most common composition of the girdling material is interwoven nylon or lycra spandex.

Girdle portion 4 is provided to facilitate the support and shaping of a users abdomen. Girdle portion 4 should be sized and configured so as to not be excessively uncomfortable to a user while wearing girdle 2. Girdle portion 4 is adapted to be substantially covered by a user's clothing. However, girdle portion 4 can be adapted to be exposed, such that observers could observe the girdle portion 4.

Figure 6:
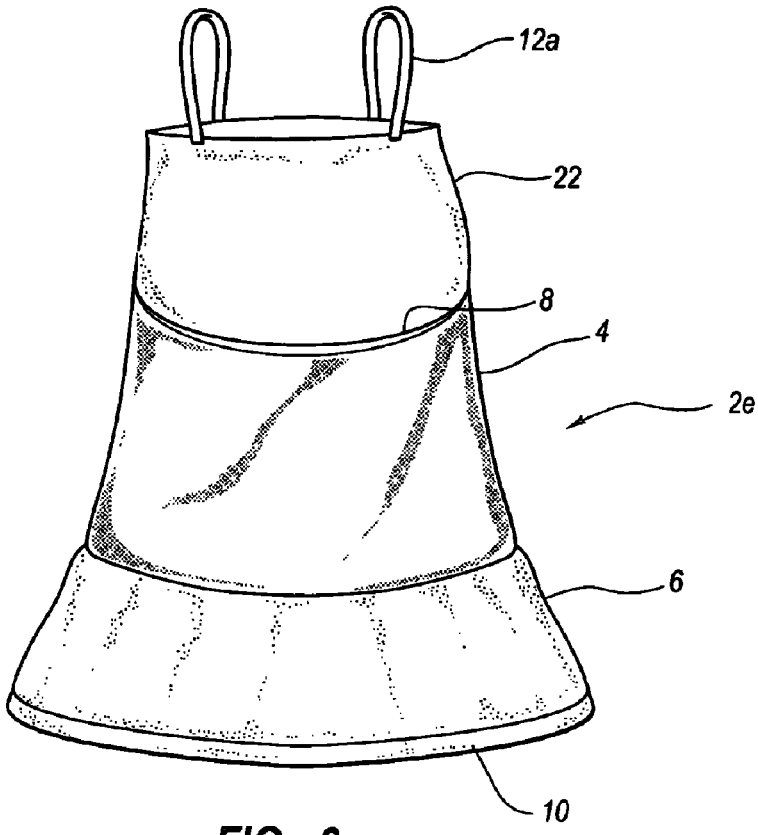
FIG. 6 illustrates yet an alternative embodiment of a faux-shirt girdle having a camisole upper portion.

Shirt portion 6 is coupled to the bottom portion of girdle portion 4. Shirt portion 6 is configured to allow the user to wear girdle portion 4 under another article of clothing, such as a shirt as illustrated in FIG. 6, and project an illusion that the user is wearing a shirt underneath the outer layer of clothing. Shirt portion 6 is further configured to extend down substantially beyond the cut line of the user's pants, shorts, or skirt, as the case may be. This facilitates the covering of the user's midriff so that the user's stomach and lower back are substantially covered. Further, shirt portion 6 is configured to reduce migration of the girdle portion 4 toward a user's chest.

In one embodiment, shirt portion 6 extends downward from the hip area approximately two to seven inches below the hips. Optimally, shirt portion 6 extends downward from the hip area of the user approximately one to two inches below the user's hips. However, in order to ensure shirt portion 6 substantially covers the midriff and lower back portions of a user, shirt portion 6 should extend at least an inch below the cut line of the user's pants so as to be positioned over the pants. In this way, shirt portion 6 will resist movement due to its being stretched over the user's pants, which in turn facilitates the reduction in migration of the lower portion of girdle portion 4 towards the user's chest line.

Shirt portion 6 may be either tucked in or may be worn over the user's other exterior layers of clothing. Shirt portion 6 may comprise a cotton-based fabric. The material of shirt portion 6 should have sufficient resiliency so as to enable the shirt portion 6 to reduce migration of the girdle portion 4 toward a user's chest. As will be understood by one having ordinary skill in the art, various sizes and designs of shirt portions can be utilized without departing from the scope and spirit of the invention. The girdle 2 should be sized appropriately for the user in order for the girdle portion 4 and shirt portion 6 to have any effect on the user. Shirt portion 6 can be any color and can be made of any suitable clothing fabric sufficient to serve the purposes described herein. Shirt portion 6 can comprise a solid piece of material, or can comprise a lace type material.

In one embodiment, girdle 2 further comprises a hem 10 along the bottom of faux shirt portion 6. Hem 10 may be used to make the bottom portion further resemble a shirt bottom. Hem 10 may also facilitate the reduction of migration of the girdle portion 4 toward a user's chest line.

Figure 2:
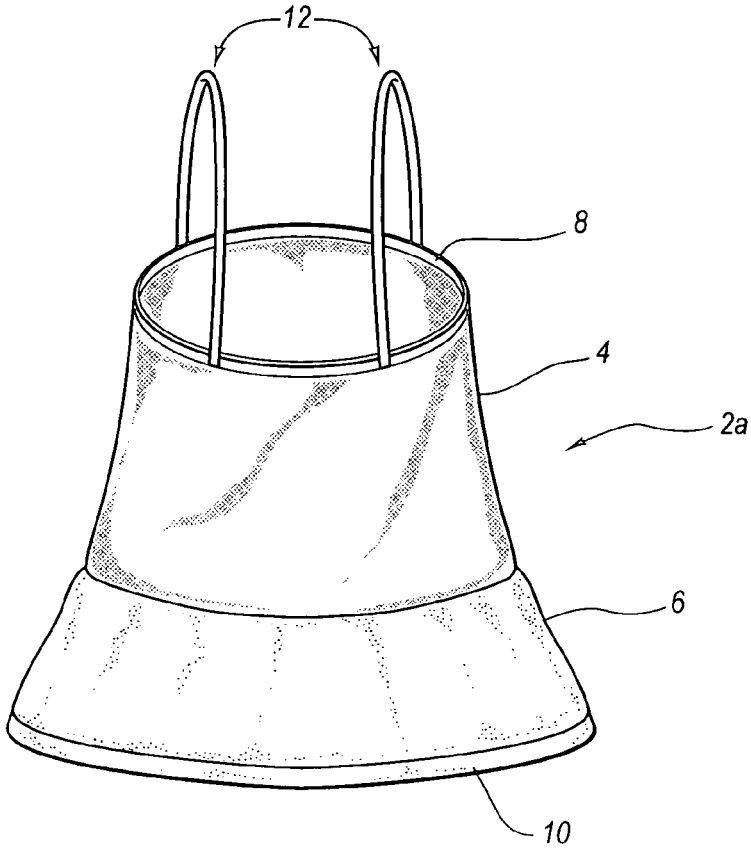
FIG. 2 illustrates an alternative embodiment of a faux-shirt girdle having shoulder straps.

FIG. 2 illustrates an alternative embodiment of girdle 2*a*. In this embodiment, girdle 2*a* comprises two support straps 12 coupled to girdle portion 4 adjacent resilient band 8. In one embodiment, support straps 12 are of sufficient length so as to be positioned over a user's shoulders. Shoulder straps 12 can be configured to be exposed or not exposed, depending on the user's preference. Shoulder straps 12 are commonly know as spaghetti straps. Shoulder straps 12 can be made of any suitable material, such as a cotton fiber or synthetic material. Shoulder straps 12 can be utilized to reduce migration of the girdle portion 4 toward the user's hips. Shoulder straps are one example of a second shirt portion.

Figure 3:
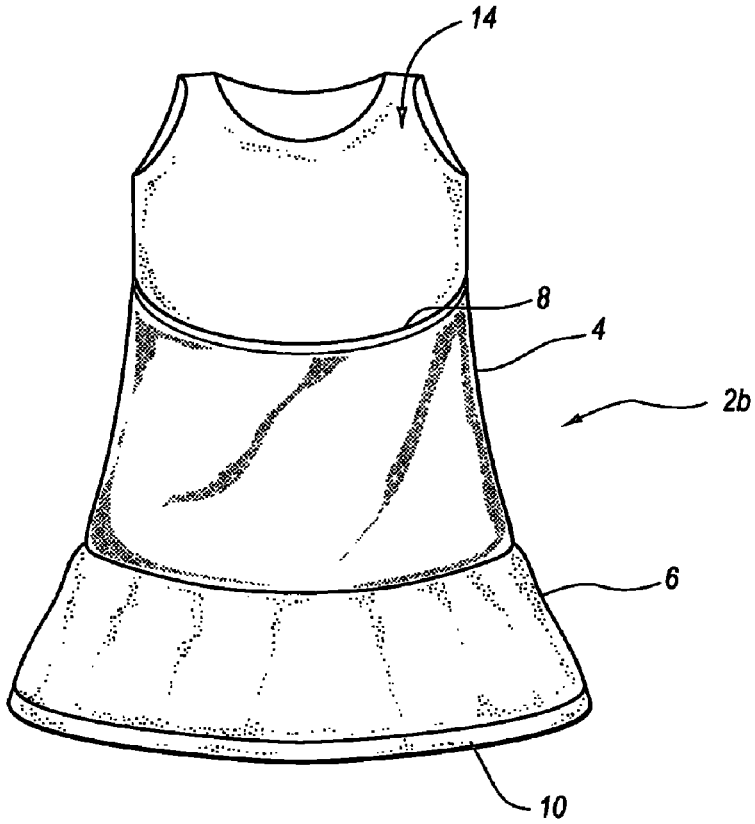
FIG. 3 illustrates an alternative embodiment of a faux-shirt girdle having a cap sleeve upper portion.

FIG. 3 illustrates an alternative embodiment of girdle 2*b*. In this embodiment, girdle 2*b* comprises a tank-top portion or cap-sleeve portion 14 coupled to girdle portion 4 or resilient band 8. Use of tank-top or cap-sleeve portion 14 results in a shirt-like appearance at both the top and the bottom of the torso while simultaneously retaining the benefits of girdle portion 4. Portion 14 can be made of any suitable material, such as a cotton material or blend, and/or a synthetic material and/or blend. Portion 14 can be utilized to reduce migration of the girdle portion 4 toward the user's hips. Portion 14 is one example of a second shirt portion.

Figure 4:
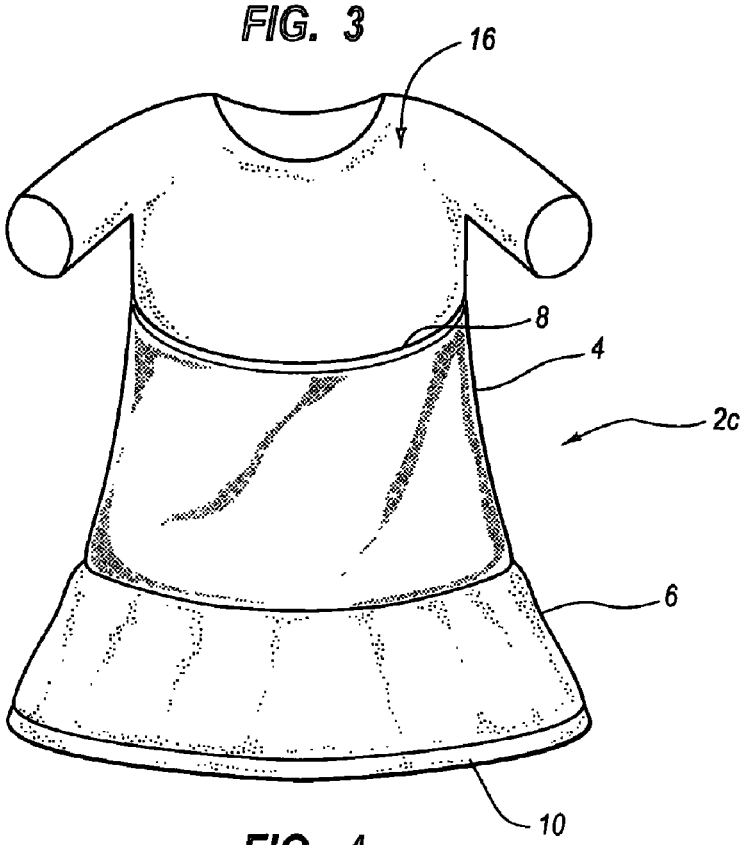
FIG. 4 illustrates an alternative embodiment of a faux-shirt girdle having a tee shirt upper portion.

FIG. 4 illustrates an alternative embodiment of girdle 2*c*. In this embodiment, girdle 2*c* comprises a tee-shirt portion 16 coupled to girdle portion 4 or resilient band 8. Use of tee-shirt portion 16 results in a shirt-like appearance at both the top and the bottom of the torso while simultaneously retaining the benefits of girdle portion 4. Tee-shirt portion 16 can be made of any suitable material, such as a cotton material or blend, and/or a synthetic material and/or blend. In one embodiment, the fabric used for both the tee-shirt portion 16 and the shirt portion 6 is the same so that the undergarment simultaneously presents a shirt-like appearance at both the top and bottom of the torso. Tee-shirt portion 16 can be utilized to reduce migration of the girdle portion 4 toward the user's hips. Tee-shirt portion 16 is another example of a second shirt portion.

Figure 5:
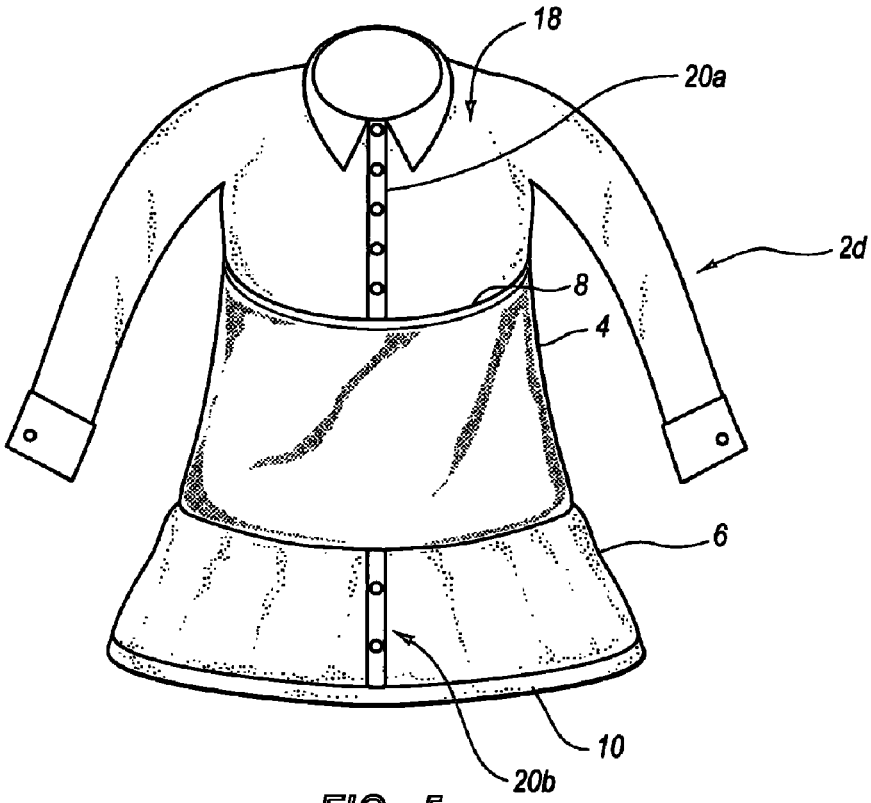
FIG. 5 illustrates yet an additional alternative embodiment of a faux-shirt girdle.

FIG. 5 illustrates an alternative embodiment of girdle 2*d*. In this embodiment, girdle 2*d* comprises a button-down shirt portion 18 coupled to girdle portion 4 or resilient band 8. Use of button-down shirt portion 18 results in a shirt-like appearance at both the top and the bottom of the torso while simultaneously retaining the benefits of girdle portion 4. Button-down shirt portion 18 can be made of any suitable material, such as a cotton material or blend, and/or a synthetic material and/or blend. In one embodiment, the fabric used for both the button-down shirt portion 18 and the shirt portion 6 is the same so that the undergarment simultaneously presents a shirt-like appearance at both the top and bottom of the torso. Button-down shirt portion 18 can be utilized to reduce migration of the girdle portion 4 toward the user's hips. In this embodiment, button portions 20*a* and 20*b* are utilized so as to give the girdle 2*d* a button-down, collar-style shirt. FIG. 5 also shows that shirt portion 6 can be attached to girdle portion 4 at a location above the lower terminus of girdle portion 4 so that the girdle portion 4 can extend past the beginning location of shirt portion 6. Portion 18 is another example of a second shirt portion.

FIG. 6 illustrates an alternative embodiment of girdle 2. In this embodiment, girdle 2*e* comprises a camisole shirt portion 22 coupled to girdle portion 4 adjacent resilient band 8. In one embodiment, camisole shirt portion 22 comprises two shoulder straps 12*a* of sufficient length so as to be positioned over a user's shoulders. Shoulder straps 12*a* can be configured to be exposed or not exposed, depending on the user's preference. Shoulder straps 12*a* are similar to those illustrated in FIG. 2. Camisole shirt portion 22 can be made of any suitable material, such as a cotton fiber or synthetic material. Camisole shirt portion 22 can be utilized to reduce migration of the girdle portion 4 toward the user's hips. Camisole shirt portion 22 is yet another example of a second shirt portion.

While the tee-shirt portion 16 in FIG. 4 is illustrated with short sleeves, and the button-down shirt portion 18 in FIG. 5 is illustrated with long sleeves, any sleeve style can be used with any shirt style. Further, a basic tee shirt version of the invention may use a type girdle fabric for girdle portion 4 and white cotton lycra fabric for shirt portion 6. Other embodiments result from modifications to the design of the shirt portion and modification to girdle portion. The faux shirt portion 6 can also be extended upward to the top of the girdle portion 4, over the girdle portion 4, whereby the faux shirt portion conceals the entire girdle portion 4, thus providing an additional layer in the girdle portion 4 region, and giving the appearance of a normal shirt, camisole or tank-top.

Figure 7:
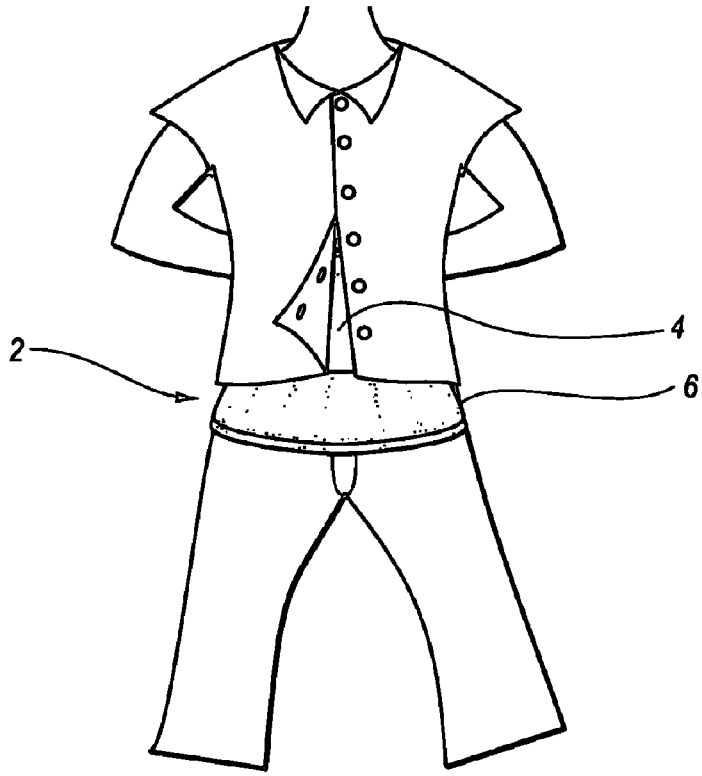
FIG. 7 illustrates the faux-shirt girdle being worn by an individual.

FIG. 7 illustrates an individual wearing girdle 2. As shown in FIG. 7, girdle 2 is worn under the user's button-up shirt and the shirt portion 6 is exposed. The lower portion of the user's shirt is unbuttoned so as to illustrate the girdle portion 4 as being concealed by the user's shirt, while allowing the shirt portion 6 to be exposed. In this manner, the shirt portion 6 extends beyond the user's hips and cut line of the user's pants. This allows for the girdle 2 to support and shape a user's abdomen, while providing coverage of a user's midriff and lower back.

Figure 8:
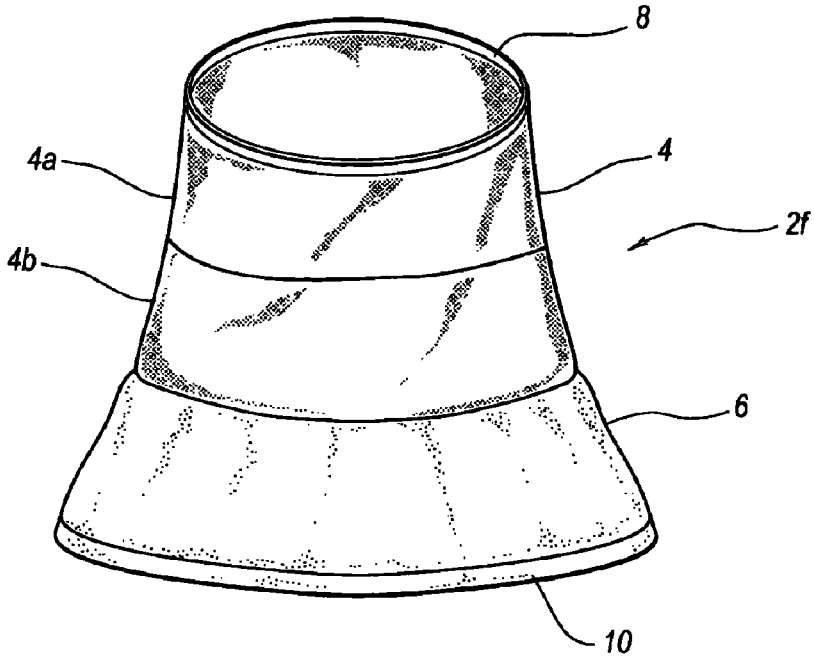
FIG. 8 illustrates an alternative embodiment of a girdle portion.

FIG. 8 is an alternative embodiment of girdle 2. In the illustrated embodiment, girdle 2*f* comprises a girdle portion 4 coupled to a shirt portion 6. In this embodiment, girdle portion comprises a first girdle subportion 4*a* coupled to a second girdle subportion 4*b*. Girdle subportions may be comprises of different materials or similar materials. In one embodiment, the material of first girdle subportion 4*a* is different than the material of second girdle subportion 4*b*. In an alternative embodiment, the materials are the same. The elasticity of the girdle subportions can be relatively the same, or they can be substantially different. As will be appreciated by one of ordinary skill in the art, a variety of types, configurations and sizes of materials can be utilized without departing from the spirit and scope of the invention. For example, a user may prefer to have more support in the upper abdomen than the lower abdomen. In this case, the user may prefer a first girdle subportion 4*a* having less elasticity than that of the second girdle subportion 4*b*. Furthermore, the relative sizes of the girdle subportions may be changed in order to accommodate a user's preference.

Figure 9:
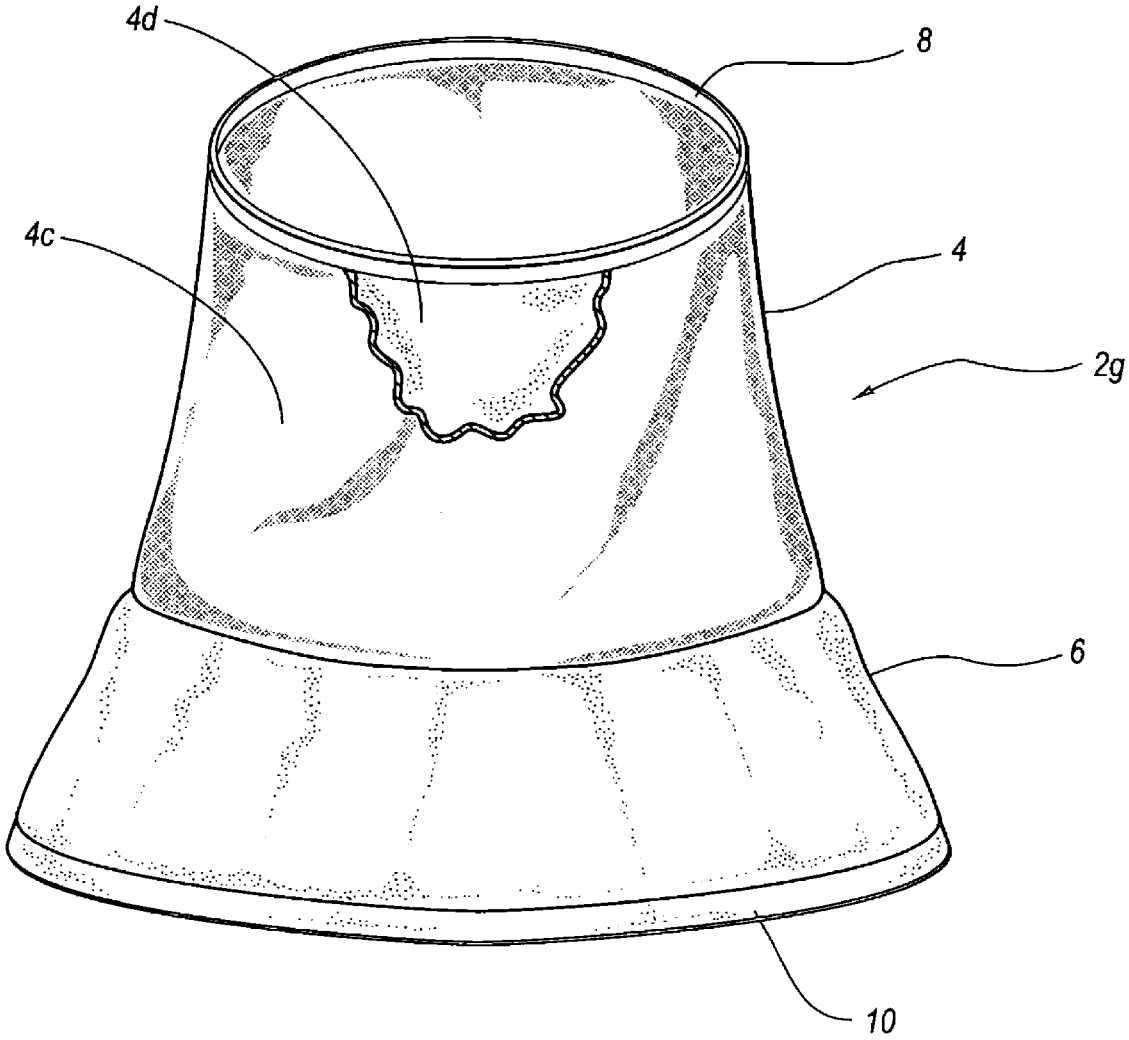
FIG. 9 illustrates yet another alternative embodiment of a girdle portion.

FIG. 9 illustrates a partial cut-away view of a girdle 2*g* having a first girdle subportion 4*c* layered over a second girdle subportion 4*d*. In the illustrated embodiment, a portion of first girdle subportion 4*c* is cut-away so as to expose second girdle subportion 4*d* and illustrate the manner in which girdle subportions are layered. When girdle subportions are layered in this manner, a greater degree of support may be extended to a user due to the layers of the girdle material. Unique configurations of layers may be utilized which will accommodate a user's preferences, as will be appreciated by one of ordinary skill in the art.

Some of the advantages present in this invention include the following: the ability to add a style and color accent to an outfit or ensemble through use of the girdle; comfort knowing one's modesty is assured when bending over, as a result of the extended length of the faux shirt portion that can either be tucked in or pulled over the user's other clothes; the faux shirt bottom also ensures that the bottom of the girdle will remain down and will not roll up; similarly, the elastic or resilient band ensures that the girdle will remain under your chest and will not roll down; the present invention gives post-pregnancy mothers support, helps them return to their pre-pregnancy form, and helps them to fit into their pre-pregnancy clothes again; the girdle slims the user's body in the girdle region; the invention aids recovery in post-surgical patents who have undergone a tummy-tuck procedure or other torso operations; the girdle provides support for the abdominal and back muscles, generally, and for pregnant women, specifically; the invention is also nursing-mother friendly because it can be worn immediately below the chest line; and the invention helps to provide a user with a more modest and slender appearance.

Common materials for use in girdle portion 4 comprise 70/30, 80/20, and 90/10 nylon/Lycra spandex. A common embodiment of the material used for shirt portion 6 comprises 90/10 cotton/Lycra.

There is also a minimal-support torso shirt that has the same dimensions as the girdle and faux shirt, but which is made of a single cotton-lycra fabric. The torso shirt begins below a user's chest and extends downward to the lower abdominal area, or five to seven inches below the hips. Materials used for the faux shirt portion can be any material that can be secured reliably to the girdle material. A benefit of cotton lycra, however, is that it can be tucked in or worn under a dress without much notice because of the way that the material moves and hugs to the user's body. The lower faux shirt portion can cover the whole girdle portion as a continuous piece from top to bottom, similar to the aforementioned torso shirt. This torso shirt version combined with a faux shirt-top would result in a full-faux-shirt version. Another benefit of the girdle is that both fabrics stick to your body and really have a slendering effect, especially the top portion of the girdle. A user can wear the invention under any shirt: half-torso or full torso. As will be appreciated by one of ordinary skill in the art, the girdle portion of the invention may be incorporated into an existing shirt, tank-top, cap-sleeve, camisole, or other article of clothing without departing from the spirit and scope of the invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A faux shirt girdle garment configured to shape and support a user's abdomen while serving to substantially cover the user's stomach and lower back regions, comprising:

a girdle portion formed from a first fabric including an elastic material, said girdle portion being configured to encircle a portion of a user's torso, said girdle portion being configured to extend from just below the bust of the user to the hips of the user such that said girdle portion provides support to the user's abdomen region, wherein said girdle portion comprises an upper portion and an opposing lower portion;

a lower shirt portion formed from a second fabric differing from said first fabric, said lower shirt portion being coupled to said lower portion of said girdle portion, wherein said lower shirt portion is sized and configured to extend from said lower portion of said girdle portion away from said girdle portion; and an upper shirt portion coupled to said upper portion of said girdle portion, wherein said upper shirt portion comprises one or more sleeves or one or more straps.

2. A faux shirt girdle garment as recited in claim 1, wherein said girdle portion comprises a resilient band in cooperation with said upper portion of said girdle portion, wherein said resilient band is configured to reduce migration of said upper portion of said girdle portion when the faux shirt girdle garment is worn by the user.

3. A faux shirt girdle garment as recited in claim 1, wherein said lower shirt portion comprises an elastic material, wherein said elastic material reduces the amount of upward migration of said lower portion of said girdle portion when the faux shirt girdle garment is worn by the user.

4. A faux shirt girdle garment as recited in claim 1, wherein said girdle portion comprises a first girdle subportion coupled to a second girdle subportion, wherein each of said first and second girdle subportions comprise an upper portion and an opposing lower portion.

5. A faux shirt girdle garment as recited in claim 4, wherein said first girdle subportion comprises a first material and said second girdle subportion comprises a second material.

6. A faux shirt girdle garment as recited in claim 5, wherein said first material is substantially the same as said second material.

7. A faux shirt girdle garment as recited in claim 5, wherein said first material is different than said second material.

8. A faux shirt girdle garment as recited in claim 4, wherein said first girdle subportion is layered on said second girdle subportion, such that said upper portion of said first girdle subportion corresponds with said upper portion of said second girdle subportion and said lower portion of said first girdle subportion corresponds with said lower portion of said second girdle subportion.

9. A faux shirt girdle garment as recited in claim 4, wherein said lower portion of said first girdle subportion is coupled to said upper portion of said second girdle subportion, such that said upper portion of said girdle portion corresponds with said upper portion of said first girdle subportion and said lower portion of said girdle portion corresponds with said lower portion of said second girdle subportion.

10. A faux shirt girdle garment as recited in claim 1, wherein said lower shirt portion is more elastic than said girdle portion.

11. A faux shirt girdle garment as recited in claim 1, wherein said lower shirt portion is less elastic than said girdle portion.

12. A faux shirt girdle garment configured to shape and support a user's abdomen while serving to substantially cover the user's stomach and lower back regions, comprising:

a girdle portion formed from a first fabric including an elastic material, said girdle portion being configured to encircle a user's torso, and extend from just below the bust of the user to the hips of the user such that said girdle portion shapes and supports a user's abdomen region, wherein said girdle portion comprises an upper portion and an opposing lower portion;

a lower shirt portion formed from a second fabric differing from said first fabric, said lower shirt portion being sewn to said lower portion of said girdle portion, wherein said shirt portion extends away from said lower girdle portion; and an upper shirt portion sewn to said upper portion of said girdle portion, said upper shirt portion being configured to cover at least a portion of the bust of the user, and to extend over at least a portion of a shoulder region of the user.

13. A faux shirt girdle garment as recited in claim 12, wherein said second fabric includes elastic material that reduces the amount of upward migration of said lower portion of said girdle portion when the faux shirt girdle garment is worn by the user.

14. A faux shirt girdle garment as recited in claim 12, wherein said upper shirt portion is formed from said second fabric.

15. A faux shirt girdle garment as recited in claim 14, wherein said upper shirt portion comprises one or more straps.

16. A faux shirt girdle garment as recited in claim 14, wherein said upper shirt portion comprises one or more sleeves.

17. A faux shirt girdle garment as recited in claim 14, wherein said upper shirt portion conveys the appearance of a button-up shirt.

18. A faux shirt girdle garment as recited in claim 14, wherein said upper shirt portion conveys the appearance of a camisole.

19. A faux shirt girdle garment as recited in claim 12, wherein said lower shirt portion is more elastic than said girdle portion.

20. A faux shirt girdle garment, comprising:

an elastic girdle portion formed from a first fabric, the girdle portion being configured to support and shape a user's abdomen region, said girdle portion being substantially uniform in length and configured to extend from just below the bust of the user to the hips of the user and encircle the user's torso, wherein said girdle portion comprises an upper portion and an opposing lower portion;

a shirt portion formed from a second fabric differing from said first fabric, said shirt portion being sewn to said lower portion of said girdle portion, said shirt portion having a length of between about 2 inches and about 7 inches, wherein said shirt portion comprises an elastic material, wherein said elastic material reduces the amount of upward migration of said lower portion of said girdle portion when the faux shirt girdle is worn by the user; and an upper shirt portion sewn to said upper portion of said girdle portion, wherein said upper shirt portion comprises one or more sleeves, or one or more straps.

21. A faux shirt girdle garment, comprising:

an elastic girdle portion configured to support and shape a user's abdomen region, said girdle portion having a first layer, a second layer, an upper edge, and an opposing lower edge, wherein said first layer: (i) is formed from a first fabric comprising between about 10% and about 30% of an elastic material, (ii) includes a front section and a back section, wherein said front and back sections are sewn together at their respective sides, and (iii) is configured to extend from just below the bust of the user to the hips of the user and encircle the user's torso, wherein said second layer is: (i) coupled directly in front of or behind at least a portion of said first layer, and (ii) configured to extend from just below the bust of the user to the hips of the user;

a shirt portion sewn to said lower edge of said girdle portion, wherein said shirt portion: (i) is formed from a second fabric having less elasticity than said first fabric, and (ii) has a length of between about 2 inches and about 7 inches; and an upper shirt portion sewn to said upper edge of said girdle portion, wherein said upper shirt portion is formed from said second fabric, and wherein said upper shirt portion comprises one or more sleeves, or one or more straps.

22. A faux shirt girdle garment as recited in claim 1, wherein said elastic material comprises spandex.

23. A faux shirt girdle garment as recited in claim 12, wherein said elastic material comprises spandex.

24. A faux shirt girdle garment as recited in claim 1, further comprising a layer of material adjacent at least a portion of said girdle portion.

25. A faux shirt girdle garment as recited in claim 24, wherein said layer of material is formed from said first fabric.

26. A faux shirt girdle garment as recited in claim 24, wherein said layer of material is formed from said second fabric.

27. A faux shirt girdle garment as recited in claim 24, wherein said layer of material is layered over at least a portion of said girdle portion.

28. A faux shirt girdle garment as recited in claim 21, wherein said second layer is formed from said first material.

29. A faux shirt girdle garment as recited in claim 21, wherein said second layer is formed from said second material.

* * * * *